US009512773B2

(12) United States Patent
Nakashima

(10) Patent No.: US 9,512,773 B2
(45) Date of Patent: Dec. 6, 2016

(54) COOLING APPARATUS FOR CONSTRUCTION MACHINE

(75) Inventor: Hajime Nakashima, Hiroshima (JP)

(73) Assignee: KOBELCO CONSTRUCTION MACHINERY CO., LTD, Hiroshima-shi (JP)

( * ) Notice: Subject to any disclaimer, the term of this patent is extended or adjusted under 35 U.S.C. 154(b) by 823 days.

(21) Appl. No.: 13/340,965

(22) Filed: Dec. 30, 2011

(65) Prior Publication Data

US 2012/0227943 A1 Sep. 13, 2012

(30) Foreign Application Priority Data

Mar. 8, 2011 (JP) ..... 2011-050560

(51) Int. Cl.
*F01P 3/18* (2006.01)
*E02F 9/08* (2006.01)
*F28D 1/04* (2006.01)

(52) U.S. Cl.
CPC ..... *F01P 3/18* (2013.01); *E02F 9/0866* (2013.01); *F28D 1/0417* (2013.01); *F28D 1/0443* (2013.01); *F01P 2003/185* (2013.01)

(58) Field of Classification Search
CPC ..... F28D 1/0426; F28D 1/0443; F01P 3/18; F01P 2003/182
USPC ..... 165/41, 67, 121, 122, 148, 149, 140; 123/41.66
See application file for complete search history.

(56) References Cited

U.S. PATENT DOCUMENTS 4,736,727 A * 4/1988 Williams ..... 165/51
5,353,757 A 10/1994 Susa et al.
5,373,892 A * 12/1994 Johnson et al. ..... 165/41
6,907,916 B2 * 6/2005 Koyama ..... 165/67
8,061,410 B2 * 11/2011 Machanek ..... 165/41
8,317,889 B2 * 11/2012 Kobayashi ..... F01P 11/12 165/119
2003/0085027 A1 5/2003 Koyama
2003/0106502 A1 6/2003 Penn et al.
2011/0056668 A1 * 3/2011 Taras et al. ..... 165/174

FOREIGN PATENT DOCUMENTS

JP 2002-21566 A 1/2002
JP 2005-262970 A 9/2005
JP 2005262970 A * 9/2005
JP 2010-159691 7/2010
JP 2010159691 A * 7/2010
JP 20100159691 * 7/2010

* cited by examiner

*Primary Examiner* — Frantz Jules
*Assistant Examiner* — Nelson Nieves
(74) *Attorney, Agent, or Firm* — Oblon, McClelland, Maier & Neustadt, L.L.P.

(57) ABSTRACT

The present invention is directed to a cooling apparatus comprising a plural number of (e.g., first to third) heat exchangers arranged in widthwise side-by-side relation to each other, and designed to optimize an air-volume distribution of cooling air passing through cores of the heat exchangers to thereby improve cooling efficiency. Each of the cores 41, 51 of the second and third heat exchangers 40, 50 disposed at widthwise opposite ends of the first to third heat exchangers 30, 40, 50 is formed to have a height lower than that of the core 31 of the first heat exchanger 30 disposed at a center of the first to third heat exchangers 30, 40, 50, whereby a combination of the cores 31, 41, 51 of the first to third heat exchangers 30, 40, 50 is formed in a shape corresponding to a projection of a cooling fan 25.

5 Claims, 7 Drawing Sheets

COOLING APPARATUS FOR CONSTRUCTION MACHINE

BACKGROUND OF THE INVENTION

1. Field of the Invention

The present invention relates to a cooling apparatus for a construction machine.

2. Description of the Related Art

Heretofore, as a cooling apparatus for a construction machine, there has been known one type designed to allow cooling air sucked by a cooling fan to pass through respective cores of a plural number of heat exchangers arranged in widthwise side-by-side relation to each other to thereby perform heat exchange (see, for example, JP 2010-159691A: hereinafter referred to as "Patent Document").

In a cooling apparatus disclosed in the Patent Document, two cores having different heights are arranged in side-by-side relation, due to the restriction of installation space. Therefore, in order to suppress vibration and noise, an inter-core step region where a projection of the cooling fan does not fall within (i.e., protrudes from) a surface of the two cores is expanded in a radially outward direction of the cooling fan to form a volume increase portion, or a bypass air passage is provided to lead air behind the cores to the inter-core step region.

However, the cooling apparatus disclosed in the Patent Document is primarily intended to suppress vibration and noise due to a difference in height between the cores. Thus, it is not designed considering that a variation in air volume occurs due to a difference in airflow resistance between the cores.

Specifically, the cooling apparatus disclosed in the Patent Document comprises two generally rectangular-shaped cores having different heights, wherein a region failing to overlap the projection of the cooling fan exists above an upper edge of a lower one (hereinafter referred to as "lower core") of the two cores (a relatively large region which extends beyond the upper edge of the lower core and the projection). The cooling fan has a circular shape, and an air-volume distribution of cooling air passing through the cores concentrates in a region corresponding to the projection of the cooling fan. Thus, there remains the need for improvement in terms of cooling efficiency.

SUMMARY OF THE INVENTION

In view of coping with the above need, it is an object of the present invention to, in a cooling apparatus comprising a plural number of heat exchangers arranged in side-by-side relation, optimize an air-volume distribution of cooling air passing through the cores to thereby improve cooling efficiency.

The present invention is directed to a cooling apparatus for a construction machine, which comprises at least three heat exchangers (a plural number of heat exchangers) arranged in widthwise side-by-side relation to each other, and a cooling fan disposed opposed to the plural number of heat exchangers, and designed to provide the following solution.

In the present invention, each of the plural number of heat exchangers has a core (a portion of the heat exchanger where fluid within the heat exchanger is heat-exchanged with external cooling air), wherein each of the cores of the heat exchangers disposed at widthwise opposite ends of the plural number of heat exchangers is formed to have a height lower than that of the core of the heat exchanger disposed at a center of the plural number of heat exchangers, whereby a combination of the cores of the plural number of heat exchangers is formed in a shape corresponding to a projection of the cooling fan.

In one aspect of the present invention, a combination of the cores of the plural number of heat exchangers is formed in a shape corresponding to a projection of the cooling fan. In other words, each of the cores of the heat exchangers disposed at the widthwise opposite ends of the plural number of heat exchangers is formed to have a height lower than that of the core of the heat exchanger disposed at the center of the plural number of heat exchangers.

This structure makes it possible to optimize an air-volume distribution of cooling air passing through the cores of the plural number of heat exchangers arranged in side-by-side relation. Specifically, the cores have a rectangular shape, whereas the cooling fan has a circular shape. Thus, the air-volume distribution of cooling air passing through the cores concentrates in a region corresponding to the projection of the cooling fan, and the cooling air is less likely to flow through corners of the cores. In the present invention, the height of each of the cores of the heat exchangers disposed at the widthwise opposite ends is lowered so as to allow a combination of the cores of the plural number of heat exchangers to be formed in a shape corresponding to the projection of the cooling fan. Thus, it becomes possible to increase a ratio of a surface area of the cores occupied by the projection of the cooling fan, i.e., a region having a relatively large air volume, to the entire surface area of the cores, so as to optimize an air-volume distribution of cooling air passing through the cores. This makes it possible to improve cooling efficiency.

These and other objects, features and advantages of the invention will become apparent upon reading the following detailed description along with the accompanying drawings.

DETAILED DESCRIPTION OF INVENTION

With reference to the drawings, the present invention will now be described based on an embodiment thereof. The following preferred embodiments will be essentially described simply by way of illustration, but not intended to limit the present invention, or applicable objects or uses thereof.

First Embodiment

Figure 1:
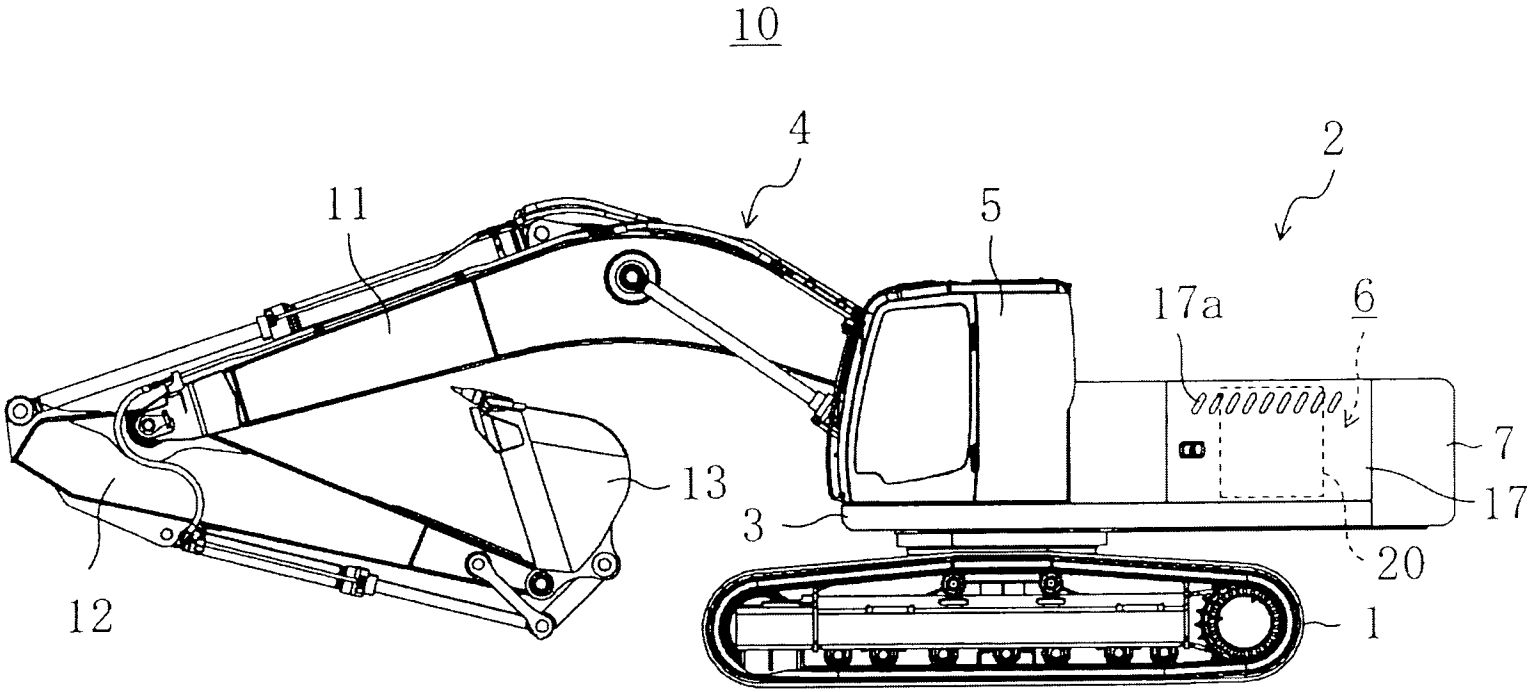
FIG. 1 is a side view illustrating an overall structure of a constriction machine employing a cooling apparatus according to a first embodiment of the present invention.
Figure 2:
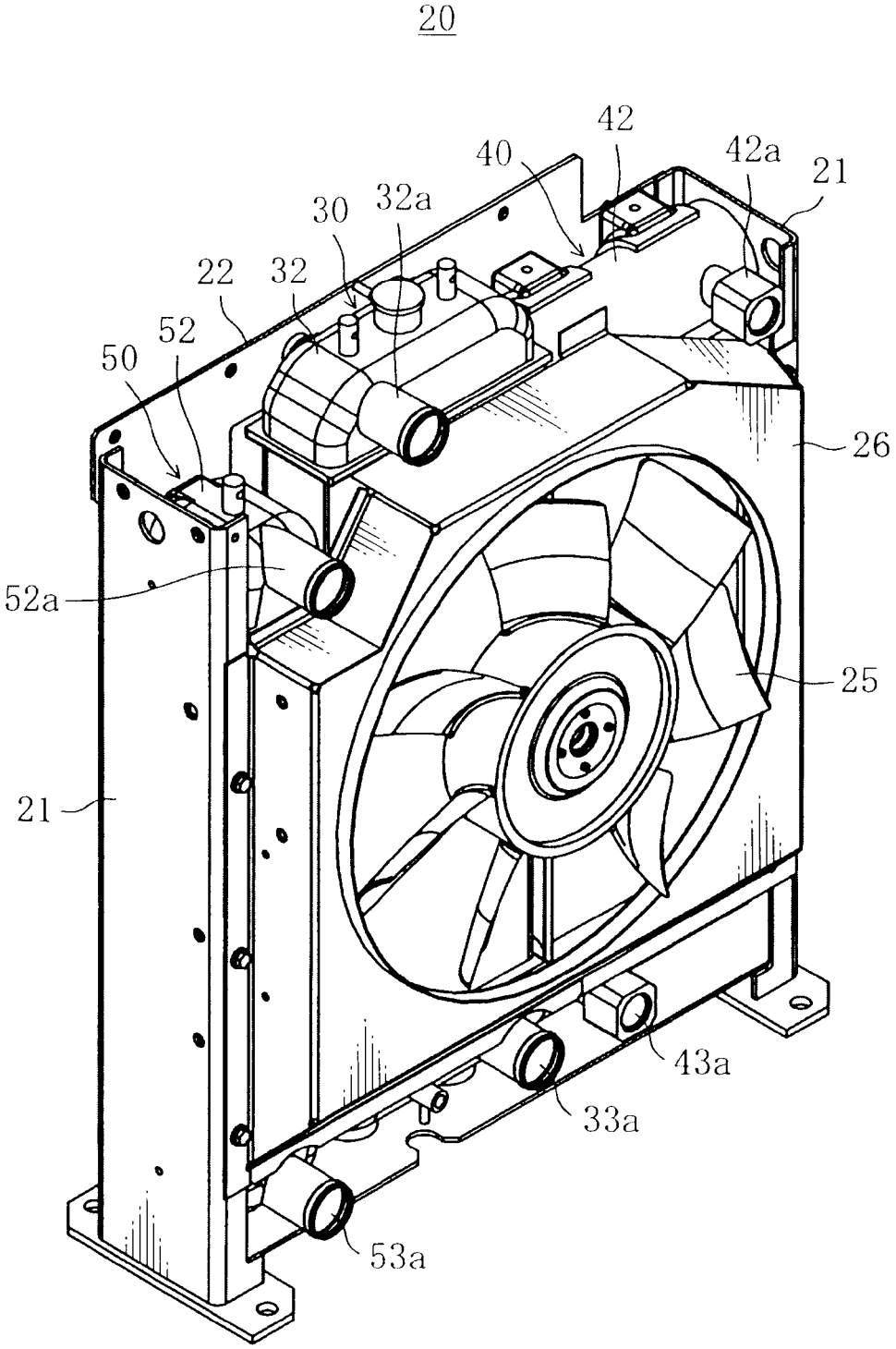
FIG. 2 is a perspective view illustrating a structure of the cooling apparatus when viewed from the side of a cooling fan.
Figure 3:
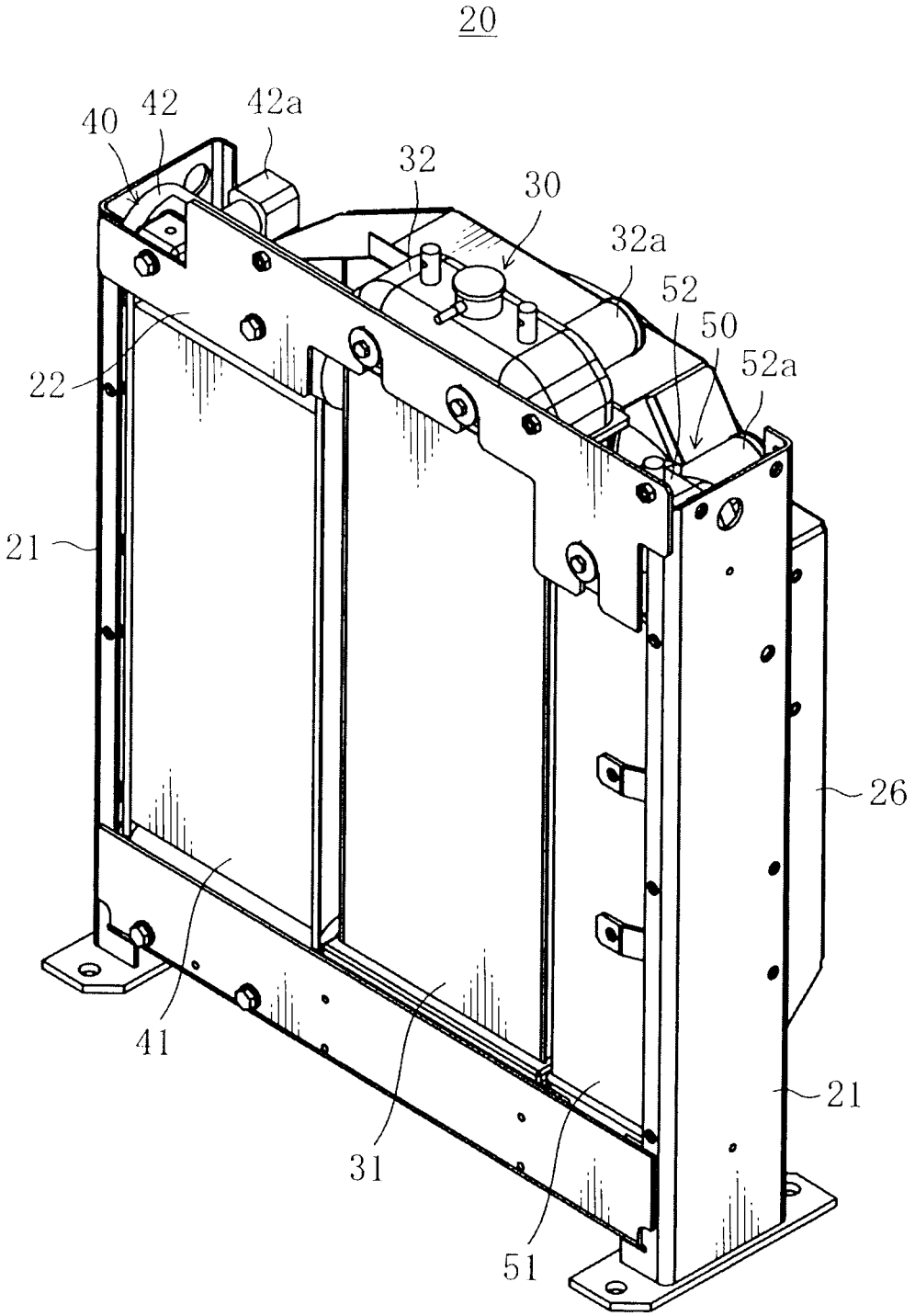
FIG. 3 is a perspective view illustrating the structure of the cooling apparatus when viewed from the side of a hear exchanger.
Figure 4:
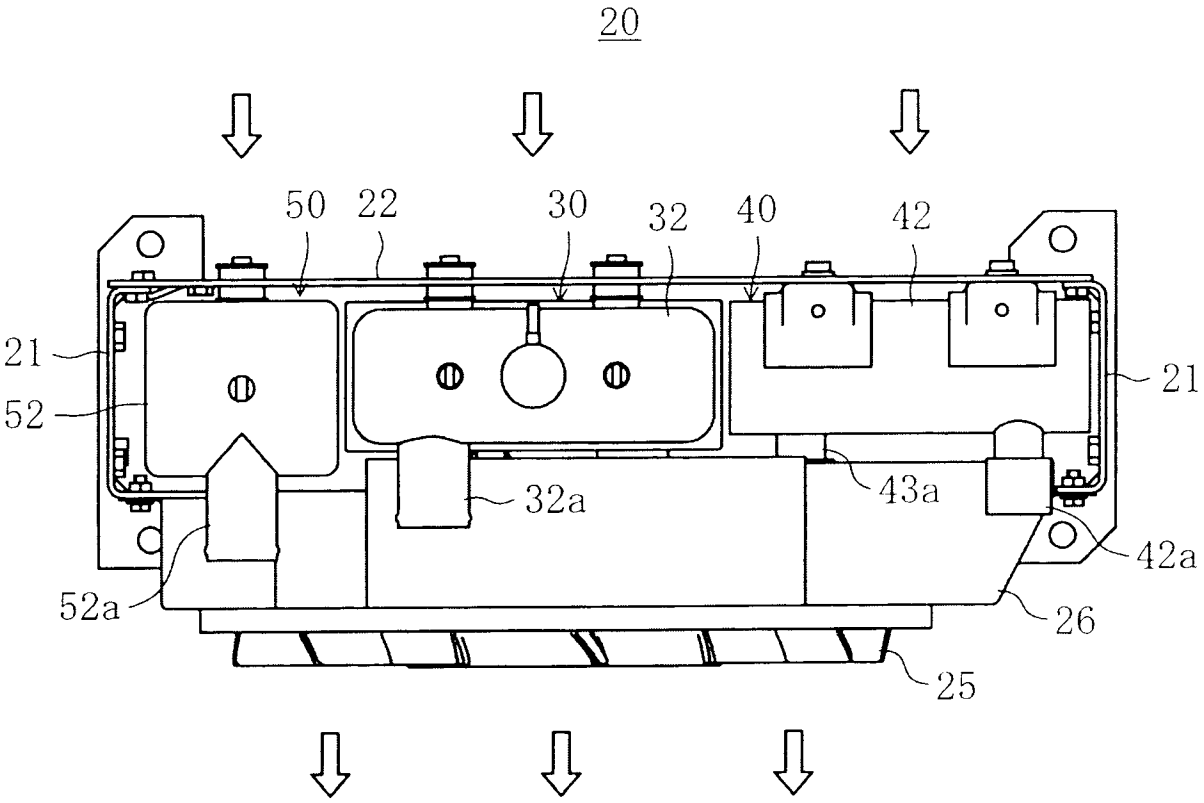
FIG. 4 is a top plan view illustrating the structure of the cooling apparatus.
Figure 5:
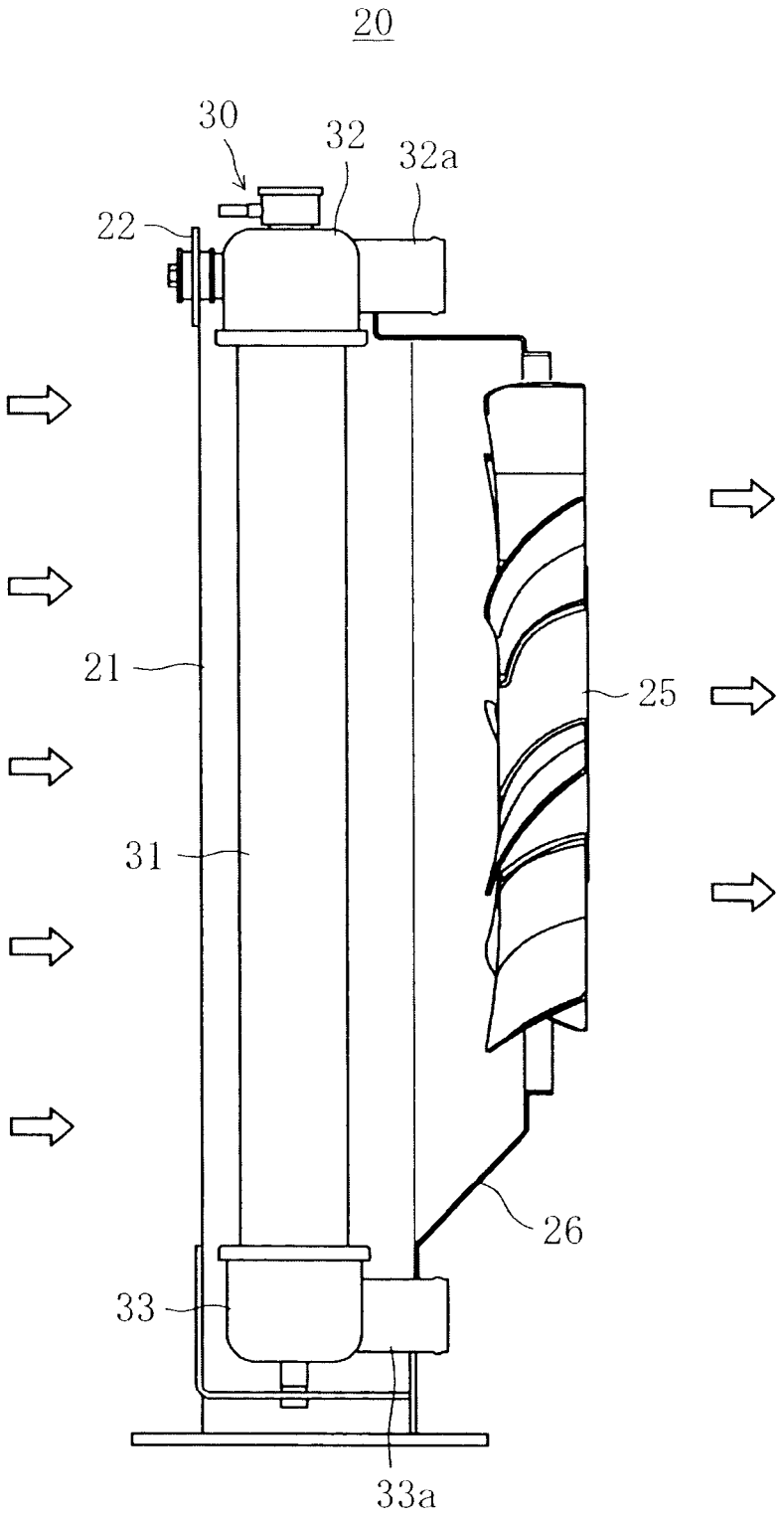
FIG. 5 is a side sectional view illustrating the structure of the cooling apparatus.

FIG. 1 is a side view illustrating an overall structure of a constriction machine employing a cooling apparatus according to a first embodiment of the present invention. As illustrated in FIG. 1, the construction machine 10 is a hydraulic shovel which comprises a crawler-type base carrier 1 and a swivel upper body 2 (body frame) rotatably mounted on the base carrier 1. The swivel upper body 2 has a body frame 3 to which an attachment 4, a cab 5, a machine room 6, a counterweight 7, etc., are attached.

In the first embodiment, a left side of the drawing sheet of FIG. 1, i.e., a side of the construction machine 10 at which the attachment 4 is disposed, will be referred to as "front (frontward)", and a front side with respect to the drawing sheet of FIG. 1, i.e., a side of the construction machine 10 toward which the cab 5 is disposed offset, will be referred to as "left (leftward)". In the following description, directions, such as frontward, rearward, rightward and leftward directions, will be followed by this definition, unless otherwise mentioned.

The attachment 4 is supported by a front and central portion of the swivel upper body 2 in a vertically swingable manner. The attachment 4 comprises a generally L-shaped boom 11 swingably supported by a pair of vertical plates (not illustrated) provided at approximately central positions of the body frame 3, an arm 12 provided on a longitudinal plane of the boom 11 and swingably supported by the boom 11, and a bucket 13 swingably supported by the arm 12.

The cab 5 is a rectangular box-shaped operator's room which is internally equipped with an operator's seat, various control devices, various operating devices, etc., and disposed on a front and left side of the swivel upper body 2 so that it is located on a left side of and adjacent to the attachment 4.

The machine room 6 is provided to extend between right and left sides of a rear portion of the swivel upper body 2. The counterweight 7 is provided to extend between right and left sides of a rear end of the swivel upper body 2. A left end of the machine room 6 is covered by a body cover 17. The body cover 17 has an air inlet opening 17*a* for taking outside air into the machine room 6. A right end of the machine room 6 has an air outlet opening (illustration is omitted) for discharging the intake air.

The machine room 6 is internally provided with a cooling apparatus 20 according to a first embodiment of the present invention. As illustrated in FIGS. 2 to 5, the cooling apparatus 20 comprises a cooling fan 25, first to third heat exchangers 30, 40, 50 disposed upstream of the cooling fan 25 in an airflow direction, and a shroud 26 which covers an outer periphery of the cooling fan 25.

The cooling fan 25 is adapted to suck outside air from the air inlet opening 17*a* and allow the sucked outside air to flow through the machine room 6 as cooling air. Cooling air sucked by the cooling fun 25 passes through the first to third heat exchangers 30, 40, 50 to cool coolant and operating oil during the passing. The cooling air after the heat exchange is led toward the cooling fan 25 by the shroud 26, and, after cooling an engine, etc., discharged from the air outlet opening (illustration is omitted) to an outside of the machine room 6.

Each of the first to third heat exchangers 30, 40, 50 is formed in a vertically-long rectangular shape, and they are disposed in widthwise side-by-side relation to each other. In the first embodiment, the first heat exchanger 30, the second heat exchanger 40 and the third heat exchanger 50 are formed as a radiator for cooling the engine, an oil cooler for cooling the operating oil, an intercooler for a turbocharger, respectively.

The first heat exchanger 30 comprises a core 31, and upper and lower tanks 32, 33 attached, respectively, to upper and lower ends of the core 31 so as to temporarily reserve engine coolant. An inflow pipe 32*a* is connected to the upper tank 32 to allow the coolant to flow in the upper tank 32. An outflow pipe 33*a* is connected to the lower tank 33 to allow the coolant after being heat-exchanged with the cooling air in the core 31 to flow out of the lower tank 33.

The second heat exchanger 40 comprises a core 41, and upper and lower tanks 42, 43 attached, respectively, to upper and lower ends of the core 41 so as to temporarily reserve operating oil. An inflow pipe 42*a* is connected to the upper tank 42 to allow the operating oil to flow in the upper tank 42. An outflow pipe 43*a* is connected to the lower tank 43 to allow the operating oil after being heat-exchanged with the cooling air in the core 41 to flow out of the lower tank 43.

The third heat exchanger 50 comprises a core 51, and upper and lower tanks 52, 53 attached, respectively, to upper and lower ends of the core 51 so as to temporarily reserve air compressed by a turbocharger (illustration is omitted). An inflow pipe 52*a* is connected to the upper tank 52 to allow the compressed air to flow in the upper tank 52. An outflow pipe 53*a* is connected to the lower tank 53 to allow the air after being heat-exchanged with the cooling air in the core 51 to flow out of the lower tank 53.

Figure 6:
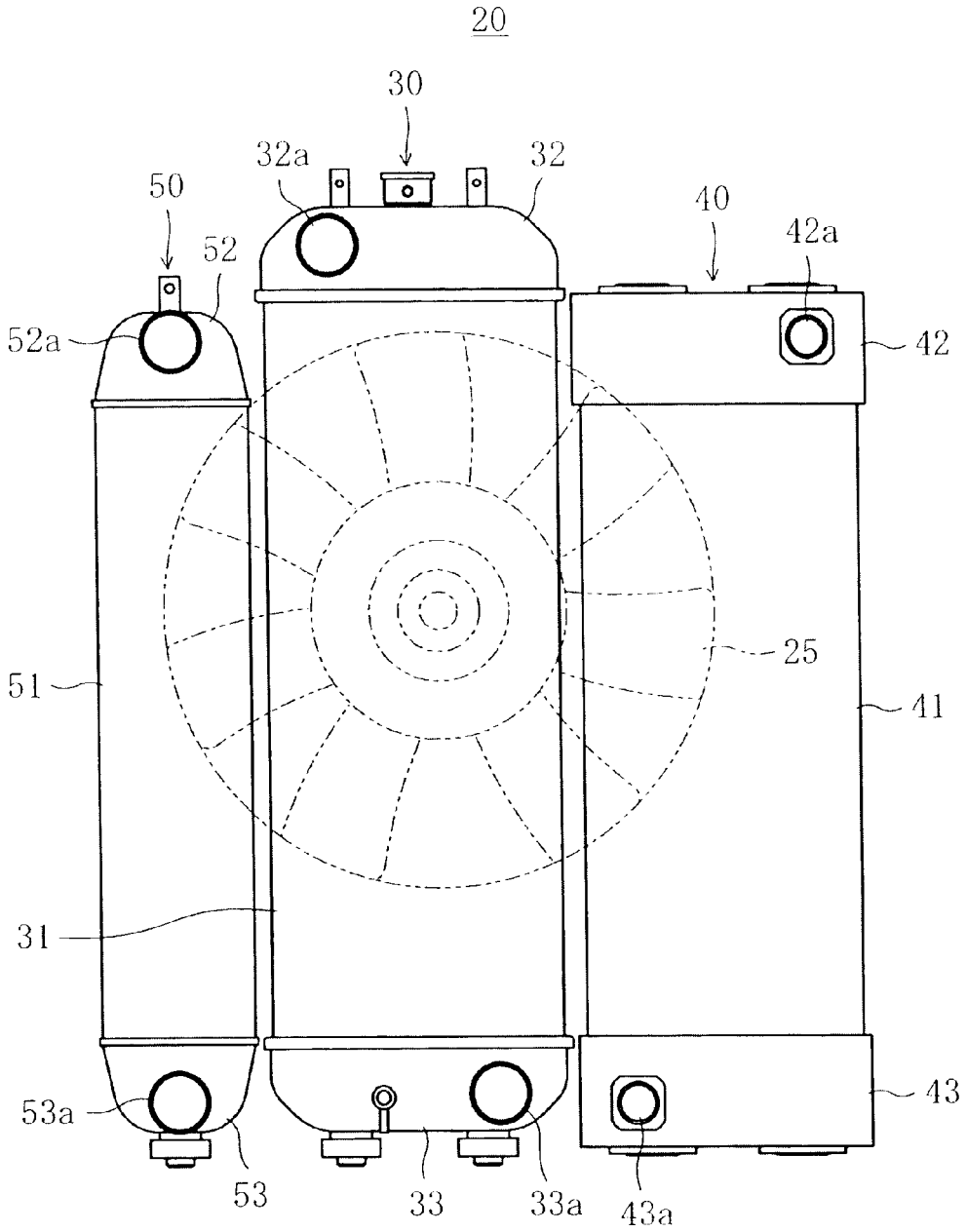
FIG. 6 is a front view illustrating a positional relationship between the heat exchanger and a projection of the cooling fan.

The respective cores 31, 41, 51 of the first to third heat exchangers 30, 40, 50 are different from each other in height. Specifically, as illustrated in FIG. 6, each of the cores 41, 51 of the second and third heat exchangers 40, 50 disposed at widthwise opposite ends of the first to third heat exchangers 30, 40, 50 is formed to have a height lower than that of the core 31 of the first heat exchanger 30 disposed at a center of the first to third heat exchangers 30, 40, 50.

In other words, a height of each of the cores 41, 51 of the second and third heat exchangers 40, 50 is set such that a position of an intersecting point between each of opposed lateral edges of the core 31 of the first heat exchanger 30 and an outer peripheral edge of a projection of the cooling fan 25 approximately coincides with a position of an upper end of a corresponding one of the cores 41, 51 of the second and third heat exchangers 40, 50. In this manner, a combination of the cores 31, 41, 51 of the first to third heat exchangers 30, 40, 50 is formed in a shape corresponding to the projection of the cooling fan 25.

Thus, it becomes possible to increase a ratio of a surface area of the cores 31, 41, 51 of the first to third heat exchangers 30, 40, 50 occupied by the projection of the cooling fan 25, i.e., a region having a relatively large air volume, to the entire surface area of the cores 31, 41, 51, so as to optimize an air-volume distribution of cooling air passing through the cores 31, 41, 51. This makes it possible to improve cooling efficiency.

In the first embodiment, only heights of the first to third heat exchangers 30, 40, 50 are modified while keeping lower ends thereof at the same level, so that it becomes possible to install the first to third heat exchangers 30, 40, 50 on a flat surface so as to facilitate an installation operation therefor.

The first to third heat exchangers 30, 40, 50 are housed in between a pair of housing frames 21, 21. The housing frame 21 comprises a pair of heightwise extending members each formed in a sectionally angular-C shape and disposed in widthwise spaced-apart relation. The housing frame 21 has a mounting bracket 22 attached between respective upper portions of the pair of members on an upstream side in the airflow direction (in FIG. 5, on the left side).

The mounting bracket 22 supports the respective upper tanks 32, 42, 52 of the first to third heat exchangers 30, 40, 50 to allow the first to third heat exchangers 30, 40, 50 to be immovably fixed within the housing frame 21. Thus, the first to third heat exchangers 30, 40, 50 can be easily demounted from the housing frames 21 and subjected to maintenance, simply by detaching the mounting bracket 22.

The cooling fan 25 is disposed downstream of the housing frame 21 in the airflow direction. The outer periphery of the cooling fan 25 is covered by the shroud 26. The shroud 26 is attached to the housing frame 21.

A dust collecting filter (illustration is omitted) is provided between the body cover 17 and each of the first to third heat exchangers 30, 40, 50, to prevent the entry of foreign substances, such as dust included in air sucked by the cooling fan 25.

As above, in the cooling apparatus 20 according to the first embodiment, no core is provided in a region out of the projection of the cooling fan 25, i.e., on an assumption that the cores 31, 41, 51 of the first to third heat exchangers 30, 40, 50 are considered as a single integral core, no core is provided in a region corresponding to two upper corners of the integral core. This makes it possible to optimize an air-volume distribution of cooling air passing through the cores 31, 41, 51 to thereby improve cooling efficiency.

Second Embodiment

Figure 7:
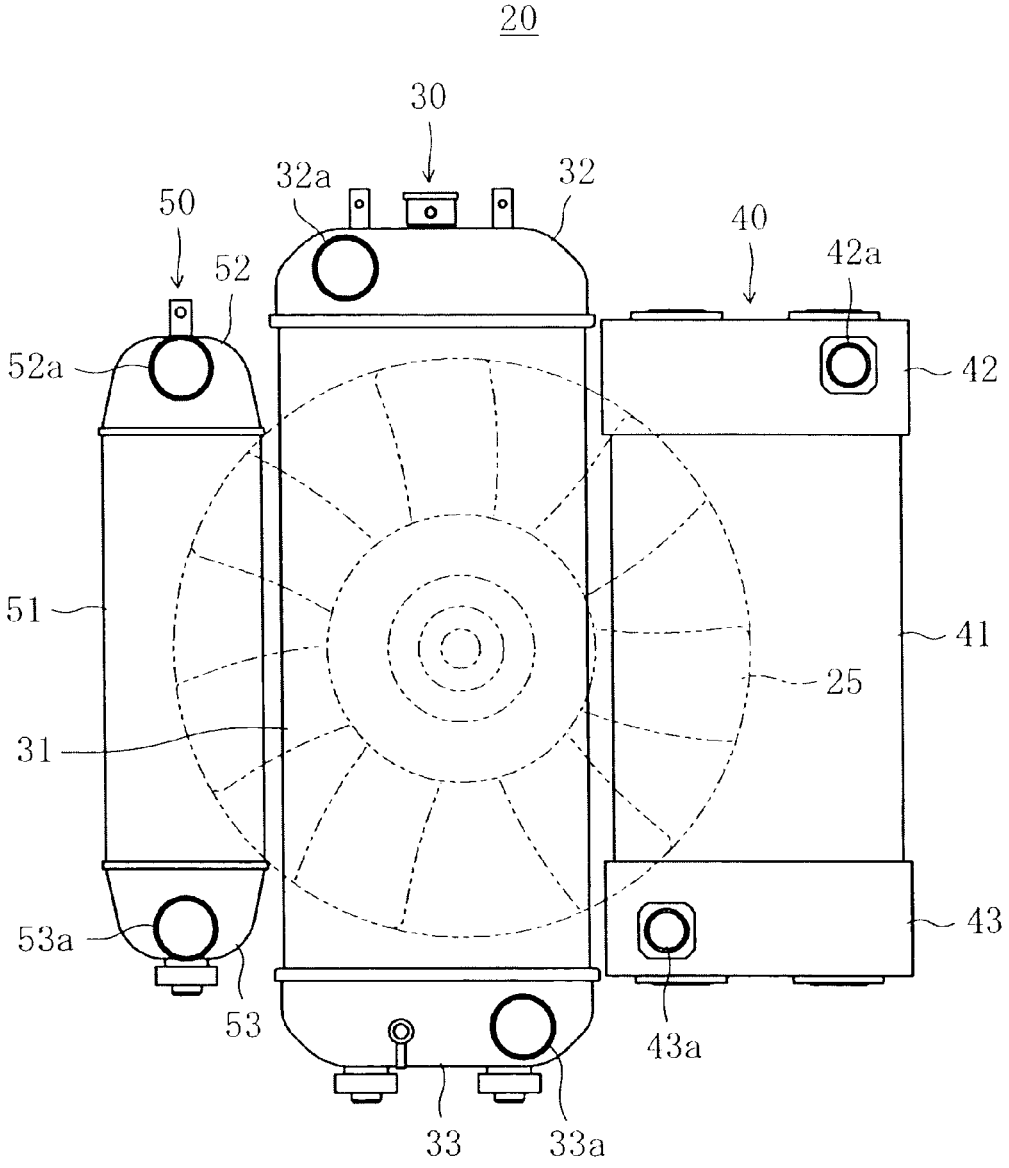
FIG. 7 is a front view illustrating a positional relationship between a heat exchanger and a projection of a cooling fan in a cooling apparatus according to a second embodiment of the present invention.

FIG. 7 is a front view illustrating a positional relationship between a heat exchanger and a projection of a cooling fan in a cooling apparatus according to a second embodiment of the present invention. The second embodiment is different from the first embodiment only in respective overall lengths of the cores 31, 41, 51. Thus, the same component as that in the first embodiment is defined by a common reference numeral, and the following description will be made only about the difference.

As illustrated in FIG. 7, each of the cores 41, 51 of the second and third heat exchangers 40, 50 disposed at the widthwise opposite ends of the first to third heat exchangers 30, 40, 50 is formed in a shape where each of heightwise opposite ends of the core (41, 51) is sunk with respect to that of the core 31 of the first heat exchanger 30 disposed at the center of the first to third heat exchangers 30, 40, 50.

In other words, the height of each of the cores 41, 51 of the second and third heat exchangers 40, 50 is set such that a position of an upper intersecting point between each of opposed lateral edges of the core 31 of the first heat exchanger 30 and an outer peripheral edge of the projection of the cooling fan 25 approximately coincides with a position of an upper end of a corresponding one of the core 41, 51 of the second and third heat exchangers 40, 50, and a position of a lower intersecting point between each of the opposed lateral edges of the core 31 of the first heat exchanger 30 and the outer peripheral edge of the projection of the cooling fan 25 approximately coincides with a position of a lower end of a corresponding one of the core 41, 51 of the second and third heat exchangers 40, 50. In this manner, a combination of the cores 31, 41, 51 of the first to third heat exchangers 30, 40, 50 is formed in a shape corresponding to the projection of the cooling fan 25.

As above, in the second embodiment, no core is provided in a region out of the projection of the cooling fan 25, i.e., on an assumption that the cores 31, 41, 51 of the first to third heat exchangers 30, 40, 50 are considered as a single integral core, no core is provided in a region corresponding to upper and lower corners of the integral core. Thus, it becomes possible to increase a ratio of a surface area of the cores 31, 41, 51 of the first to third heat exchangers 30, 40, 50 occupied by the projection of the cooling fan 25, i.e., a region having a relatively large air volume, to the entire surface area of the cores 31, 41, 51, so as to optimize an air-volume distribution of cooling air passing through the cores 31, 41, 51 to thereby improve cooling efficiency

Other Embodiments

Although the cooling apparatuses 20 according to the first and second embodiment have been described based on a structure where the three heat exchangers 30, 40, 50 are arranged in side-by-side relation, the cooling apparatuses of the present invention is not limited to such a structure, but may comprise four or more heat exchangers arranged in side-by-side relation.

Although the first and second embodiment have been described based on an example where the cooling apparatus of the present invention is applied to a hydraulic shovel, the cooling apparatus of the present invention can be widely applied to various types of construction machines, such as a demolition machine and a crushing machine.

In summary, the present invention is directed to a cooling apparatus for a construction machine, which comprises at least three heat exchangers (a plural number of heat exchangers) arranged in widthwise side-by-side relation to each other, and a cooling fan disposed opposed to the plural number of heat exchangers, and characterized by the following features.

In the present invention, each of the plural number of heat exchangers has a core (a portion of the heat exchanger where fluid within the heat exchanger is heat-exchanged with external cooling air), wherein each of the cores of the heat exchangers disposed at widthwise opposite ends of the plural number of heat exchangers is formed to have a height lower than that of the core of the heat exchanger disposed at a center of the plural number of heat exchangers, whereby a combination of the cores of the plural number of heat exchangers is formed in a shape corresponding to a projection of the cooling fan.

In one aspect of the present invention, a combination of the cores of the plural number of heat exchangers is formed in a shape corresponding to a projection of the cooling fan. In other words, each of the cores of the heat exchangers disposed at the widthwise opposite ends of the plural number of heat exchangers is formed to have a height lower than that of the core of the heat exchanger disposed at the center of the plural number of heat exchangers.

This structure makes it possible to optimize an air-volume distribution of cooling air passing through the cores of the plural number of heat exchangers arranged in side-by-side relation. Specifically, the cores have a rectangular shape, whereas the cooling fan has a circular shape. Thus, the air-volume distribution of cooling air passing through the cores concentrates in a region corresponding to the projection of the cooling fan, and the cooling air is less likely to flow through corners of the cores. In the present invention, the height of each of the cores of the heat exchangers disposed at the widthwise opposite ends is lowered so as to allow a combination of the cores of the plural number of heat exchangers to be formed in a shape corresponding to the projection of the cooling fan. Thus, it becomes possible to increase a ratio of a surface area of the cores occupied by the projection of the cooling fan, i.e., a region having a relatively large air volume, to the entire surface area of the cores, so as to optimize an air-volume distribution of cooling air passing through the cores. This makes it possible to improve cooling efficiency.

Preferably, in the cooling apparatus of the present invention, each of the cores of the heat exchangers disposed at the widthwise opposite ends of the plural number of heat exchangers is formed in a shape where at least one of heightwise opposite ends of the core is sunk with respect to that of the core of the heat exchanger disposed at the center of the plural number of heat exchangers.

According to this feature, upper and lower ends of each of the cores of the heat exchangers disposed at the widthwise opposite ends can be sunk with respect to the core of the heat exchanger disposed at the center, to further optimize the air-volume distribution of cooling air passing through the cores. In other words, no core is provided in a region out of the projection of the cooling fan, i.e., on an assumption that the cores of the plural number of heat exchangers are considered as a single integral core, no core is provided in a region corresponding to upper and lower corners of the integral core.

In a specific preferred embodiment of the present invention, a height of an upper end of at least one of the cores of the heat exchangers disposed at the widthwise opposite ends of the plural number of heat exchangers is set such that a position of an intersecting point between a lateral edge of the core and an outer peripheral edge of the projection of the cooling fan approximately coincides with a position of the upper end of the core.

More preferably, a height of an upper end of each of the cores of the two heat exchangers disposed at the widthwise opposite ends of the plural number of heat exchangers is set such that a position of an intersecting point between a lateral edge of each of the cores and an outer peripheral edge of the projection of the cooling fan approximately coincides with a position of the upper end of the core.

According to the above feature, the height of the upper end of each of the cores of the heat exchangers disposed at the widthwise opposite ends is adjusted to approximately coincide with the intersecting point between the lateral edge of each of the cores and the outer peripheral edge of the projection of the cooling fan, so that it becomes possible to optimize the air-volume distribution of cooling air passing through the cores. In other words, a region out of the projection of the cooling fan can be reduced to, on an assumption that the cores of the plural number of heat exchangers are considered as a single integral core, effectively increase a ratio of a surface area of the integral core occupied by the projection of the cooling fan, i.e., a region having a relatively large air volume, to the entire surface area of the integral core.

In another preferred embodiment of the present invention, a height of a lower end of at least one of the cores of the two heat exchangers disposed at the widthwise opposite ends is set such that the position of the intersecting point between the lateral edge of the core and the outer peripheral edge of the projection of the cooling fan approximately coincides with a position of the lower end of the core.

More preferably, a height of a lower end of each of the cores of the two heat exchangers disposed at the widthwise opposite ends is set such that the position of the intersecting point between the lateral edge of each of the cores and the outer peripheral edge of the projection of the cooling fan approximately coincides with a position of the lower end of the core.

According to the above feature, the height of the lower end of each of the cores of the heat exchangers disposed at the widthwise opposite ends is adjusted to approximately coincide with the intersecting point between the lateral edge of each of the cores and the outer peripheral edge of the projection of the cooling fan, so that it becomes possible to optimize the air-volume distribution of cooling air passing through the cores. In other words, a region out of the projection of the cooling fan can be reduced to, on an assumption that the cores of the plural number of heat exchangers are considered as a single integral core, effectively increase a ratio of a surface area of the integral core occupied by the projection of the cooling fan, i.e., a region having a relatively large air volume, to the entire surface area of the integral core.

This application is based on Japanese Patent Application Serial No. 2011-050560 filed in Japan Patent Office on Mar. 8, 2011, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A cooling apparatus for a construction machine, comprising:

at least three heat exchangers arranged in a widthwise side-by-side direction in relation to each other, each of the at least three heat exchangers including a core that performs heat exchange, an upper tank provided on an upper end of the core, and a lower tank provided on a lower end of the core;

a bracket connecting the upper tanks of the at least three heat exchangers with one another; and a cooling fan singly disposed opposed to the at least three heat exchangers, wherein the upper end of each of the cores of the heat exchanger disposed at widthwise opposite ends of the at least three heat exchangers is at a lower position than that of the core of the heat exchanger disposed at a center of the at least three heat exchangers, a combination of the cores of the at least three heat exchangers having a general upper outer shape concentric with a circular projection of the cooling fan, wherein each of the upper tanks of the heat exchangers disposed at the widthwise opposite ends of the at least three heat exchangers is at a lower position that that of the upper tank of the heat exchanger disposed at the center of the at least three heat exchangers, wherein a width, in the widthwise side-by-side direction, of the core of the heat exchanger disposed at the center of the at least three heat exchangers is greater than a width of both of the heat exchangers disposed at the widthwise opposite ends; and wherein the respective lower tanks of the at least three heat exchangers are on the same level.

2. The cooling apparatus as defined in claim 1, wherein the height of at least one of the cores of the heat exchangers disposed at the widthwise opposite ends of the at least three heat exchangers is set such that a position of an intersecting point between a lateral edge of the core and an outer peripheral edge of the circular projection of the cooling fan coincides with a position of an upper end of the core.

3. The cooling apparatus as defined in claim 1, wherein the at least three heat exchangers are housed in a housing frame having a pair of heightwise extending members disposed in widthwise spaced-apart relation.

4. The cooling apparatus as defined in claim 3, wherein the bracket is attached between respective upper portions of the pair of heightwise extending members.

5. The cooling apparatus as defined in claim 3, wherein the bracket detachably connects the respective upper tanks of the at least three heat exchangers with one another.

* * * * *